US008013528B2

(12) United States Patent
Otsu et al.

(10) Patent No.: US 8,013,528 B2
(45) Date of Patent: Sep. 6, 2011

(54) PLASMA DISPLAY MEMBER AND METHOD FOR MANUFACTURING PLASMA DISPLAY MEMBER

(75) Inventors: Takafumi Otsu, Shiga (JP); Tetsuo Uchida, Shiga (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 12/812,199

(22) PCT Filed: Jan. 29, 2009

(86) PCT No.: PCT/JP2009/051404

§ 371 (c)(1),
(2), (4) Date: Jul. 8, 2010

(87) PCT Pub. No.: WO2009/096440

PCT Pub. Date: Aug. 6, 2009

(65) Prior Publication Data

US 2010/0283374 A1 Nov. 11, 2010

(30) Foreign Application Priority Data

Jan. 30, 2008 (JP) ..... 2008-018709

(51) Int. Cl.
*H01J 17/49* (2006.01)
*H01J 9/00* (2006.01)

(52) U.S. Cl. ..... 313/582; 313/583; 313/584; 313/585; 313/586; 445/24

(58) Field of Classification Search ..... 313/582–587; 445/24

See application file for complete search history.

(56) References Cited

U.S. PATENT DOCUMENTS 5,906,527 A * 5/1999 Shaikh et al. ..... 445/24
6,507,148 B1 * 1/2003 Iguchi et al. ..... 313/582
6,540,576 B1 * 4/2003 Watanabe et al. ..... 445/24

(Continued)

FOREIGN PATENT DOCUMENTS

JP 2-165538 A 6/1990

(Continued)

OTHER PUBLICATIONS

Machine English translation of KR 20090049579 to Kamada et al. published May 18, 2009.*

(Continued)

*Primary Examiner* — Sikha Roy
(74) *Attorney, Agent, or Firm* — Birch, Stewart, Kolasch & Birch, LLP

(57) ABSTRACT

A plasma display member comprises a plurality of substantially stripe-shaped address electrodes (7) formed on a substrate (5), a dielectric layer (6) covering the address electrodes, main barrier ribs (8) located on the dielectric layer and formed substantially in parallel with the address electrodes, and auxiliary barrier ribs (9) formed orthogonal to the main barrier ribs. In the plasma display member, the pitch (Pt1) between the outermost main barrier rib of the main barrier ribs located in the non-display region on both sides in the lateral direction of a display region and the main barrier rib adjacent to the outermost main barrier rib is integer times the pitch (Pt2) between the main barrier ribs located in the display region, where the integer is two or more. In addition, exposure processing is performed a plurality of times by using a photomask having a specific shape, thereby making it possible to obtain a plasma display having a high display quality and a high productivity.

5 Claims, 2 Drawing Sheets

U.S. PATENT DOCUMENTS

| | | | | |
|---|---|---|---|---|
| 2004/0075389 | A1 | 4/2004 | Kim et al. | |
| 2005/0116643 | A1 | 6/2005 | Chang et al. | |
| 2005/0215161 | A1 | 9/2005 | Adachi | |
| 2005/0236994 | A1 | 10/2005 | Kwon et al. | |
| 2006/0175969 | A1* | 8/2006 | Bae et al. | 313/582 |
| 2009/0218945 | A1* | 9/2009 | Kamada et al. | 313/582 |

FOREIGN PATENT DOCUMENTS

| | | | |
|---|---|---|---|
| JP | 2001-118513 | A | 4/2001 |
| JP | 2004-103562 | A | 4/2004 |
| JP | 2004-240095 | A | 8/2004 |
| JP | 2005-310788 | A | 11/2005 |
| JP | 2006-261106 | A | 9/2006 |
| WO | WO 2004/075234 | A1 | 9/2004 |
| WO | WO 2006/025266 | A1 | 3/2006 |
| WO | WO 2008/016003 | A1 | 2/2008 |

OTHER PUBLICATIONS

International Search Report, dated Mar. 31, 2009, issued in PCT/JP2009/051404.

* cited by examiner

PLASMA DISPLAY MEMBER AND METHOD FOR MANUFACTURING PLASMA DISPLAY MEMBER

TECHNICAL FIELD

The present invention relates to a plasma display member and a plasma display member manufacturing method.

BACKGROUND ART

As a display for large, thin TV sets, a plasma display has attracted greater attention. FIG. 5 schematically shows an oblique perspective view of a structure of a pixel in a plasma display. In the example given in FIG. 5, a glass substrate 12 in the front plate 18 that serves as a display screen carries two or more pairs of a sustain electrode 14 and a scan electrode 13 that are produced from silver, chromium, aluminum, nickel, etc., and aligned to form stripes with their length direction coinciding with the longitudinal direction of a display region in which the longitudinal and transverse directions are parallel to the short and long sides of the display region. A black stripe 15 that serves to maintain contrast in a displayed image may be provided between the pixels in the longitudinal direction of the plasma display. The sustain electrode 14 and scan electrode 13 are clad in a 20 to 50 μm thick glass-based dielectric layer 16 that is coated with a protection layer 17.

In the glass substrate 19 in the rear plate 25, on the other hand, two or more address electrodes 20 are provided to form stripes with their length direction coinciding with the longitudinal direction, and the address electrodes 20 are clad in a glass-based dielectric layer 21. A main barrier rib 22 and an auxiliary barrier rib 23 are formed on the dielectric layer 21 to separate discharge cells, and a phosphor layer 24 is provided in a discharge space formed by the barrier ribs and dielectric layer 21. For a full-color plasma display, the phosphor layer consists of materials that emit red (R), green (G), or blue (B) light. The front plate and the rear plate are sealed in such a way that the sustain electrode 14 in the front plate 18 extends perpendicular to the address electrode 20 in the rear plate 25, and rare gas such as helium, neon, and xenon fills the gap between these substrates to form a plasma display. Each pixel is formed with its center at the intersection of the scan electrode 13 and the address electrode 20, and the plasma display has two or more pixels to display an image.

When an image is produced in a plasma display, a voltage larger than the breakdown voltage is applied to the luminescence-free space between the scan electrode 13 and the address electrode 20 in a selected pixel, producing cations and electrons through ionization. Since the pixel is a capacitative load, they move through the discharge space toward the electrode with the opposite polarity, resulting in electrification on the inner wall of the protection layer 17. Since the protection layer 17 has a high resistance, the electric charge on the inner wall will be retained as wall charge.

Then, a self-sustaining discharge voltage is applied between the scan electrode 13 and the sustain electrode 14. If wall charge exists, electrical discharge can take place at a voltage lower than the breakdown voltage. Electrical discharge excites xenon gas in the discharge space to generate 147 nm ultraviolet ray, and this ultraviolet ray in turn excites the phosphor layer 24 to cause luminescence to produce an image.

In a known method to form an address electrode, dielectric layer, barrier rib, and phosphor layer to constitute the rear plate of a plasma display, a substrate is coated or laminated with a photosensitive paste, and then exposed to light through an appropriate pattern, followed by development with an appropriate developer.

In a proposed method (Patent Literature 1), for instance, a photosensitive paste layer consisting of ceramic powder and ultraviolet curable resin is formed over a substrate and exposed to light through a photomask with an appropriate pattern, followed by development and calcination.

However, when a barrier rib grid comprising main barrier ribs and auxiliary barrier ribs is formed by grid-like patterning and calcination of a paste coating layer composed of ceramic powder and resin, bulged portions will be produced at the intersections of the main barrier ribs and the auxiliary barrier ribs, while the front plate and the barrier ribs will not come in contact in the other portions, leading to undesired discharge.

The above method has a problem because if foreign matters or flaws exist on the photo mask, the patterns obtained after exposure and development will mostly contain defects such as disconnections and unintended connections to lower the yield.

As a method for solving the problem; it is proposed to prepare a photo mask with an opening length kept shorter than that of the pattern layer and carry out exposure while moving the substrate or photo mask (Patent Literatures 2 and 3). However, when a complicated pattern, such as for grid-like barrier ribs of a plasma display panel, some barrier ribs at the end of the moving path of the substrate will tend to fail to be produced properly, leading to problems such as a decrease in productivity or a decline in the quality of the resulting display panel.

Patent Literature 1: JP 2-165538 A
Patent Literature 2: JP 2004-240095 A
Patent Literature 3: WO 2006/025266 A1

SUMMARY OF INVENTION

Technical Problem

The problem to be solved by the invention is to provide a plasma display having a high display quality and a high productivity.

Solution to Problem

The problem can be solved by providing a plasma display component comprising address electrodes aligned to form two or more stripes, a dielectric layer to cover the address electrodes, main barrier ribs provided on the dielectric layer and aligned nearly parallel to the address electrodes, and auxiliary barrier ribs perpendicular to the main barrier ribs, wherein the interval between the outermost main barrier rib among the main barrier ribs located in the non-display region at either transverse end of the display region and the main barrier rib next to it is a two or more integral multiple of the interval between the main barrier ribs located in the display region.

The problem can also be solved by providing a plasma display component production method comprising preparing a substrate that carries address electrodes or address electrode precursors aligned to form stripes, a dielectric layer or dielectric layer precursor to cover the address electrodes or address electrode precursors, and a photosensitive glass paste layer formed on the dielectric layer or dielectric layer precursor, and exposing it to light through a photomask with a grid-like pattern of transparencies nearly parallel or perpendicular to the address electrodes or address electrode precursors, two or more times, followed by development and calcination, to produce a barrier rib grid comprising main barrier ribs nearly parallel to the address electrodes, and auxiliary barrier ribs perpendicular to the main barrier ribs, wherein a photomask in which the interval between the transparency for the transversely outermost main barrier rib and the transparency for the adjacent main barrier rib is a two or more integral multiple of the interval between the transparencies for the main barrier ribs located in the transverse central region is prepared, and shifted along with the substrate, between at least two light exposure operations, for a relative shift in the direction parallel to the auxiliary barrier ribs, the length of the shift being an integral multiple of the interval between the transparency for the transversely outermost main barrier rib and the transparency for the adjacent main barrier rib.

The problem can also be solved by providing a plasma display component production method comprising preparing a substrate that carries address electrodes or address electrode precursors aligned to form stripes, a dielectric layer or dielectric layer precursor to cover the address electrodes or address electrode precursors, and a photosensitive glass paste layer formed on the dielectric layer or dielectric layer precursor, and exposing it to light through a photomask with a grid-like pattern of transparencies nearly parallel or perpendicular to the address electrodes or address electrode precursors, two or more times, followed by development and calcination, to produce a barrier rib grid comprising main barrier ribs nearly parallel to the address electrodes, and auxiliary barrier ribs perpendicular to the main barrier ribs, wherein a photomask in which the interval between the transparency for the transversely outermost main barrier rib and the transparency for the adjacent main barrier rib is a two or more integral multiple of the interval between the transparencies for the main barrier ribs located in the central region is prepared, and shifted along with the substrate, between at least two light exposure operations, for a relative shift in the direction parallel to the main barrier ribs, the length of the shift being an integral multiple of the interval between the transparency for the longitudinal outermost auxiliary barrier rib and the transparency for the adjacent auxiliary barrier rib.

Advantageous Effects of Invention

The invention provides a plasma display having a high display quality and a high productivity.

REFERENCE SIGNS LIST

Figure 1:
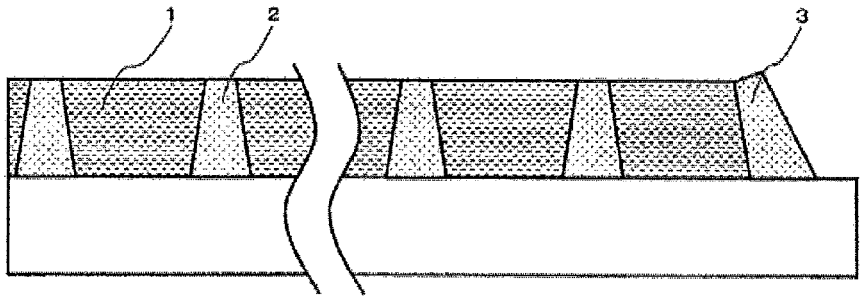
FIG. 1 is a schematic diagram of a transverse cross section of a rear plate for conventional plasma displays.

1: auxiliary barrier rib
2: main barrier rib in the display region
3: main barrier rib in the outermost region
4: photomask pattern
5: glass substrate
6: dielectric layer
7: address electrode
8: main barrier rib
9: auxiliary barrier rib
10: display region
11: non-display region
12: glass substrate
13: scan electrode
14: sustain electrode
15: black stripe
16: dielectric layer
17: protection layer
18: front plate
19: glass substrate
20: address electrode
21: dielectric layer
22: main barrier rib
23: auxiliary barrier rib
24: phosphor layer
25: rear plate
Pmt1: pitch between the transparency for the transversely outermost main barrier rib and the transparency for the adjacent main barrier rib in the photomask
Pmt2: pitch between the transparencies for the main barrier ribs located in the transverse central region
Pmy: pitch between the transparencies for the auxiliary barrier ribs
Wt1: width of the opening in the main barrier rib located in the transverse outermost region
Wt2: width of the opening in the main barrier rib located in the transverse central region
Pt1: pitch between the outermost main barrier rib among the main barrier ribs located in the non-display region at either transverse end of the display region and the main barrier rib next to it
Pt2: pitch between the main barrier ribs located in the display region
Py: pitch between the auxiliary barrier ribs
Lt1: bottom width of the outermost main barrier rib among the main barrier ribs located in the non-display region at either transverse end of the display region
Lt2: bottom width of the main barrier ribs located in the display region

DESCRIPTION OF EMBODIMENTS

The plasma display component of the invention is a plasma display component comprising address electrodes aligned to form two or more stripes, dielectric layers to cover the address electrodes, main barrier ribs provided on the dielectric layers and aligned nearly parallel to the address electrodes, and auxiliary barrier ribs perpendicular to the main barrier ribs, wherein the interval between the outermost main barrier rib among the main barrier ribs located in the non-display region at either transverse end of the display region and the main barrier rib next to it is a two or more integral multiple of the interval between the main barrier ribs located in the display region.

The transverse direction as referred to here means the direction of the longer side of the display screen as described above, and also the perpendicular direction to the address electrodes. The longitudinal direction as referred to here means the direction perpendicular to the transverse direction on the substrate, and accordingly the direction of the shorter side of the display screen, which is parallel to the address electrodes.

The fact that the interval between the outermost main barrier rib among the main barrier ribs located in the non-display region at either transverse end of the display region and the main barrier rib next to it is a two or more integral multiple of the interval between the main barrier ribs located in the display region serves to depress the bulging of the main barrier rib in the transverse outermost region when a barrier rib grid comprising main barrier ribs and auxiliary barrier ribs is produced by processing a coating film of a barrier rib paste comprising organic and inorganic components into a grid-like pattern and then calcining it.

For the invention, a two or more integral multiple may be a number that is 0.90 to 1.10 times an integer, preferably 0.95 to 1.05 times an integer, instead of an accurate integer.

For the plasma display component of the invention, it is preferable that the interval between the outermost main barrier rib among the main barrier ribs located in the non-display region at either transverse end of the display region and the main barrier rib next to it is two, three or four times the interval between the main barrier ribs located in the display region. The two times is particularly preferable.

The plasma display component production method of the invention is as follows: a plasma display component production method comprising preparing a substrate that carries address electrodes or address electrode precursors aligned to form nearly parallel stripes, dielectric layers or dielectric layer precursors to cover the address electrodes or address electrode precursors, and photosensitive glass paste layers formed on the dielectric layers or dielectric layer precursors, and exposing it to light through a photomask with a grid-like pattern of transparencies nearly parallel or perpendicular to the address electrodes or address electrode precursors, two or more times, followed by development and calcination, to produce a barrier rib grid comprising main barrier ribs nearly parallel to the address electrodes, and auxiliary barrier ribs perpendicular to the main barrier ribs, wherein a photomask in which the interval between the transparency for the transversely outermost main barrier rib and the transparency for the adjacent main barrier rib is a two or more integral multiple of the interval between the transparencies for the main barrier ribs located in the transverse central region is prepared, and moved along with the substrate, between at least two light exposure operations, for a relative shift in the direction parallel to the auxiliary barrier ribs, the length of the shift being an integral multiple of the interval between the transparency for the transversely outermost main barrier rib and the transparency for the adjacent main barrier rib.

By performing light exposure two or more times through a photomask having a grid-like transparency pattern, and moving relatively the photomask and the substrate, between at least two light exposure operations, for a shift in the direction parallel to the auxiliary barrier ribs, it is possible to depress the generation of defects such as disconnections and undesired connections even if foreign matters and flaws exist on the substrate. The photomask and the substrate are moved relatively between at least two light exposure operations, and therefore, alignment operation for positioning should preferably be performed before each of the two exposure operations to ensure high positioning accuracy for light exposure. However, although alignment operation for positioning of the substrate and the photomask should be performed each time before the first exposure operation, alignment operation may be performed only for the first plate in the case of the second exposure operation, and instead of carrying out alignment operation for the second and following plates, a cycle consisting of relative shifting of the photomask and the substrate over a certain distance determined from results of the first alignment operation, and subsequent exposure operation may be performed repeatedly. This serves to ensure positioning accuracy of the exposure operation and quick completion of the exposure operation without a decrease in productivity.

Here, a photomask in which the interval between the transparency for the transversely outermost main barrier rib and the transparency for the adjacent main barrier rib is a two or more integral multiple of the interval between the transparencies for the main barrier ribs located in the transverse central region is prepared, and moved along with the substrate, between at least two light exposure operations, for a relative shift in the direction parallel to the auxiliary barrier ribs, the length of the shift being an integral multiple of the interval between the transparency for the transversely outermost main barrier rib and the transparency for the adjacent main barrier rib. The use of such a photomask serves to produce a defect-free plasma display component that suffers little bulging of the main barrier rib in the transverse outermost region.

The interval between the transparency for the transversely outermost main barrier rib and the transparency for the adjacent main barrier rib should preferably be two, three or four times, particularly preferably two times, the interval between the transparencies for the main barrier ribs located in the transverse central region. The length of the relative shift of the photomask and the substrate in the direction of the auxiliary barrier rib, performed between at least two light exposure operations, should preferably be equal to the interval between the transparency for the transversely outermost main barrier rib and the transparency for the adjacent main barrier rib.

For the invention, a photomask having a grid-like transparency pattern is used to perform light exposure two or more times, and between at least two light exposure operations, the photomask and the substrate may be moved for a relative shift in the parallel direction to the main barrier rib in addition to the relative shift in the parallel direction to the auxiliary barrier rib. In this case, the present invention provides a plasma display component production method comprising preparing a substrate that carries address electrodes or address electrode precursors aligned to form nearly parallel stripes, dielectric layers or dielectric layer precursors to cover the address electrodes or address electrode precursors, and photosensitive glass paste layers formed on the dielectric layers or dielectric layer precursors, and exposing it to light through a photomask having a grid-like pattern of transparencies nearly parallel or perpendicular to the address electrodes or address electrode precursors, two or more times, followed by development and calcination, to produce a barrier rib grid comprising main barrier ribs nearly parallel to the address electrodes, and auxiliary barrier ribs perpendicular to the main barrier ribs, wherein a photomask in which the interval between the transparency for the transversely outermost main barrier rib and the transparency for the adjacent main barrier rib is a two or more integral multiple of the interval between the transparencies for the main barrier ribs located in the central region is prepared, and moved along with the substrate, between at least two light exposure operations, for a relative shift in the direction parallel to the main barrier ribs, the length of the shift being an integral multiple of the interval between the transparency for the longitudinal outermost auxiliary barrier rib and the transparency for the adjacent auxiliary barrier rib.

The width of the transparency opening for the longitudinal outermost auxiliary barrier rib in the photomask used for the production method should preferably be larger than the width of the transparency openings for the auxiliary barrier ribs located in the longitudinal central region.

By performing light exposure two or more times through a photomask having a grid-like transparency pattern, and moving relatively the photomask and the substrate, between at least two light exposure operations, for a shift in the direction parallel to the main barrier ribs, it is possible to depress the generation of defects such as disconnections and undesired connections even if foreign matters and flaws exist on the substrate. The photomask and the substrate are moved relatively between at least two light exposure operations, and therefore, alignment operation for positioning should preferably be performed before each of the two exposure operations to ensure high positioning accuracy for light exposure. However, although alignment operation for positioning of the substrate and the photomask should be performed each time before the first exposure operation, alignment operation may be performed only for the first plate in the case of the second exposure operation, and instead of carrying out alignment operation for the second and following plates, a cycle consisting of relative shifting of the photomask and the substrate over a certain distance determined from results of the first alignment operation, and subsequent exposure operation may be performed repeatedly. This serves to ensure positioning accuracy of the exposure operation and quick completion of the exposure operation without a decrease in productivity.

Described below are a constitution of a plasma display member of the invention, and constitution and production method of a plasma display member of the invention.

The materials to be used for a substrate of a plasma display member of the invention include soda glass and the like, specifically PD200 supplied by Asahi Glass Co., Ltd. and PP8 supplied by Nippon Electric Glass Co., Ltd. which are heat-resistant glass products designed for manufacturing of plasma displays.

Stripe-like address electrodes of metals such as silver, aluminum, chromium, nickel and the like are formed on a substrate. As forming stripe-like address electrodes, the following methods may be used. A metal pattern forming method which comprises pattern printing a metal paste containing powder of these metals and organic binders as main component on a substrate by screen printing and heating and calcining it at 400 to 600° C. or a photosensitive past method for forming a metal pattern which comprises coating a substrate with a photosensitive metal paste containing metal powder and photosensitive organic components, performing pattern exposure through a photomask, dissolving and removing unnecessary portions by development operation, and heating and calcining at 400 to 600° C. Further, an etching method which comprises sputtering metals such as chromium and aluminum on a glass substrate, coating it with resist, performing pattern exposure to the resist, developing it, and removing the metallic material in the unnecessary portions by etching may be used. It is preferable that a thickness of an electrode is in the range of 1.0 to 10 μm, more preferably 1.5 to 5 μm. If the electrode thickness is too small, resistance thereof will be too large and accurate driving will become difficult. If it is too thick, larger amounts of material will be required and this method will become inferior in terms of cost. It is preferable that a width of an address electrode is in the range of 35 to 240 μm, more preferably 30 to 150 μm. If the address electrode width is too small, resistance thereof will be too large and accurate driving will become difficult, while if it is too wide, the interval between adjacent electrodes will become small, leading to frequent short-circuits. The address electrodes are formed with an appropriate interval according to the size of the display cells (a region in which each of R, G and B are formed). It is preferable that a forming pitch of address electrode is in the range of 100 to 500 μm for general plasma display panels, and 100 to 400 μm for high definition plasma display panels.

The address electrodes are covered with a dielectric layer. The dielectric layer is formed by coating a glass paste consisting mainly of glass powder and organic binders over the address electrodes to cover them, followed by calcinations at 400 to 600° C. The glass paste used to form the dielectric layer contains one or more selected from the group consisting of lead oxide, bismuth oxide, zinc oxide, and phosphorus oxide. It is preferable to use a glass powder having a low melting point containing such oxides up to a total content of 10 to 80 mass %. The content of such a composition should be 10 mass % or more to allow calcinations to be performed easily at 600° C. or less, while it should be 80 mass % or less to prevent crystallization which will decrease the transmittance.

The glass powder having a low melting point is kneaded with an organic binder to prepare a paste. The useful organic binders include cellulose-based compounds such as ethyl cellulose and methyl cellulose, and acrylic compounds such as methyl methacrylate, ethyl methacrylate, isobutyl methacrylate, methyl acrylate, ethyl acrylate, and isobutyl acrylate. Further, the glass paste may also contain additives such as solvents and plasticizers. The useful solvents include common ones such as terpineol, butyrolactone, toluene, and methyl cellosolve. The useful plasticizers include dibutyl phthalate, and diethyl phthalate. In addition to the glass powder having a low melting point, fillers having a high softening point that will not soften during calcination may be added to produce plasma display panels having a high reflectance and high brightness. The preferred fillers include titanium oxide, aluminum oxide, and zirconium oxide. It is especially preferred to use titanium oxide having a 50% particle diameter of 0.05 to 3 μm as determined from the volumetric distribution curve. It is preferred that the filler content is such that the ratio by mass of the glass powder to the fillers is 1:1 to 10:1. If the filler content in terms of weight is not smaller than one tenth of the glass powder content, the effect of improving brightness can be obtained. If the filler content is not larger than the glass powder content, sintering capability can be kept.

Further, if conductive fine particles are added to the glass paste used to form a dielectric layer, a plasma display panel highly reliable during driving can be produced. It is preferred that the conductive fine particles are a metal powder of nickel, chromium, etc., and that the 50% particle diameter is 1 to 10 μm as determined from the volumetric distribution curve. If the particle size is 1 μm or more, the intended effect can be sufficiently exhibited, and if it is 10 μm or less, the surface ruggedness of the dielectric can be kept small to facilitate the formation of the barrier ribs on the dielectric layer which is described later. It is preferred that the content of the conductive fine particles in the dielectric layer is 0.1 to 10 mass %. If the content is 0.1 mass % or more, the electrical conductivity can be obtained, and if it is 10 mass % or less, short circuits between transversely adjacent address electrodes can be prevented. It is preferred that the thickness of the dielectric layer is 3 to 30 μm, and a more preferred range is 3 to 15 μm. If the thickness of the dielectric layer is too small, there arises a tendency that many pinholes are formed, and if it is too large, there arises a tendency that the discharge voltage becomes high to increase power consumption.

Described below are methods to produce main barrier ribs and auxiliary barrier ribs for the invention. The main barrier ribs and the auxiliary barrier ribs are formed by producing a pattern on a substrate based on a generally known technique such as screen printing, sand blasting, photosensitive paste application (photolithography), in-mold transfer, and lift-off, using a paste comprising insulating inorganic and organic components, followed by calcinations.

A photosensitive paste application method is described below.

A photosensitive paste for forming barrier ribs used in a photosensitive paste application method consists mainly of inorganic fine particles and photosensitive organic components, and contains a photopolymerization initiator, light absorbent, sensitization agent, organic solvent, sensitization assistant, and/or polymerization inhibitor, as needed.

The useful inorganic fine particles for the photosensitive paste for forming barrier ribs include particles of glass or ceramic substances (such as alumina, and cordierite). Especially preferred are glass or ceramic substances containing silicon oxide, boron oxide or aluminum oxide as an essential ingredient.

For the inorganic fine particles, an appropriate particle size is determined based on consideration on the form of the pattern to be prepared, but it is preferred that the 50% particle diameter is 1 to 10 μm as determined from the volumetric distribution curve. A more preferred range is 1 to 5 μm. If 50% particle diameter as determined from the volumetric distribution curve is 10 μm or less, the surface of the pattern obtained cab be free of roughness. If it is 1 μm or more, the viscosity of the paste can be easily adjusted. Further, it is especially preferred for pattern formation to use fine glass particles with a specific surface area of 0.2 to 3 $m^2/g$.

Since the main barrier ribs and the auxiliary barrier ribs are formed in a pattern on a glass substrate that preferably has a low softening point, it is preferred to use inorganic fine particles containing 60 mass % or more of low-melting fine glass particles having a softening temperature of 350 to 600° C. Further, if high-melting fine glass particles or fine ceramic particles having a softening temperature of above 600° C. are added as filler components, the shrinkage rate during calcination can be reduced, though it is preferred that their amount is 40 mass % or less relative to the total amount of the inorganic fine particles. It is preferred that the low-melting fine glass particles used have a linear expansion coefficient in the range of $50\times10^{-7}$ to $90\times10^{-7}$ $K^{-1}$, more preferably $60\times10^{-7}$ to $90\times10^{-7}$ $K^{-1}$, in order to prevent warp of the glass substrate during calcination.

It is preferred that low-melting fine glass particles contain silicon oxide and/or boron oxide.

It is preferred that the content of silicon oxide is in the range of 3 to 60 mass %. If it is 3 mass % or more, the compactness, strength and stability of the glass layer can be improved, and the thermal expansion coefficient can be kept in a desired range, preventing warp from being caused due to a difference in thermal expansion coefficient between the glass layer and the glass substrate. If the content of silicon oxide is 60 mass % or less, the softening point becomes low and printing on the glass substrate can be performed advantageously.

If the content of boron oxide is in the range of 5 to 50 mass %, electric, mechanical and thermal properties such as electric insulation, strength, thermal expansion coefficient, and insulation layer compactness can be improved. If it is 50 mass % or less, stability of the glass can be kept.

Further, if at least one of bismuth oxide, lead oxide and zinc oxide is contained up to 5 to 50 mass % in total, a glass paste having temperature properties suitable for patterning on the glass substrate can be obtained. If fine glass particles containing 5 to 50 mass % of bismuth oxide are used, such advantages as an increased pot life of the paste can be obtained. As bismuth-based fine glass particles, it is preferred to use a glass powder containing components as listed below:

Bismuth oxide: 10 to 40 mass %
Silicon oxide: 3 to 50 mass %
Boron oxide: 10 to 40 mass %
Barium oxide: 8 to 20 mass %
Aluminum oxide: 10 to 30 mass %

Moreover, fine glass particles containing 3 to 20 mass % of at least one of lithium oxide, sodium oxide and potassium oxide can also be used. If the content of the alkali metal oxides added is kept at 20 mass % or less, preferably 15 mass % or less, the stability of the paste can be improved. Among the aforesaid three alkali metal oxides, lithium oxide is especially preferred in view of the stability of the paste. As lithium-based fine glass particles, it is preferred to use, for example, glass powder containing components as listed below:

Lithium oxide: 2 to 15 mass %
Silicon oxide: 15 to 50 mass %
Boron oxide: 15 to 40 mass %
Barium oxide: 2 to 15 mass %
Aluminum oxide: 6 to 25 mass %

Furthermore, if fine glass particles containing both a metal oxide such as lead oxide, bismuth oxide or zinc oxide and an alkali metal oxide such as lithium oxide, sodium oxide or potassium oxide are used, the softening temperature and the linear expansion coefficient can be easily controlled at a lower alkali metal content.

Moreover, if the fine glass particles contain aluminum oxide, barium oxide, calcium oxide, magnesium oxide, titanium oxide, zinc oxide, zirconium oxide, etc., especially aluminum oxide, barium oxide and zinc oxide, processability can be enhanced, but in view of the softening point and thermal expansion coefficient, it is preferred that their content is 40 mass % or less, more preferably 25 mass % or less.

As the photosensitive organic ingredient, it is preferred to contain at least one photosensitive ingredient selected from the group of photosensitive monomers, photosensitive oligomers and photosensitive polymers.

The photosensitive monomers are compounds containing an unsaturated carbon-carbon bond. The preferable ones include acrylic monomers such as monofunctional and polyfunctional (meth)acrylates, vinyl compounds, and allyl compounds, which may be used singly or in combination.

The photosensitive oligomers and photosensitive polymers are those oligomers and polymers produced by polymerizing at least one of monomers having a carbon-carbon double bond. Preferably, they are oligomers and polymers produced by polymerizing at least one of the acrylic monomers, which may be copolymerized with other photosensitive monomers so that the content of the monomers is 10 mass % or more, more preferably 35 mass % or more. If an unsaturated acid such as an unsaturated carboxylic acid is copolymerized with the polymers or oligomers, the development property after light exposure can be improved. Specifically, practical unsaturated carboxylic acids include acrylic acid, methacrylic acid, itaconic acid, crotonic acid, maleic acid, fumaric acid, vinylacetic acid, and their acid anhydrides. It is preferred that the acid value (AV) of the polymers or oligomers with acid groups such as carboxyl groups in side chains obtained as above is in the range of 50 to 180, more preferably 70 to 140. If photoreactive groups are added to the side chains or molecular ends of the polymers and oligomers as mentioned above, they can be used as photosensitive polymers or photosensitive oligomers. Preferred photoreactive groups are ethylenic unsaturated groups. The ethylenic unsaturated groups include vinyl groups, allyl groups, acrylic groups, and methacrylic groups.

Specifically, the useful photopolymerization initiators include benzophenone, methyl O-benzoylbenzoate, 4,4-bis(dimethylamino) benzophenone, 4,4-bis(diethylamino) benzophenone, 4,4-dichlorobenzophenone, 4-benzoyl-4-methylphenylketone, dibenzyl ketone, fluorenone, 2,3-diethyoxyacetophenone, 2,2-dimethoxy-2-phenyl-2-phenylacetophenone, etc, which may be used singly or in combination. It is preferred that the content of the photopolymerization initiator added is in a range from 0.05 to 10 mass %, more preferably 0.1 to 5 mass %, relative to the total weight of the photosensitive ingredients. If the amount of the polymeric initiator is too small, there arises a tendency toward lower photosensitivity, and if it is too large, there arises a tendency that the remainder rate in the exposed area becomes too small.

It is also effective to add a light absorber. If a compound having a high effect of absorbing ultraviolet light or visible light is added, a high aspect ratio, high precision and high resolution can be obtained. As the light absorber, an organic dye can be preferably used. Practical ones include azo dyes, aminoketone dyes, xanthene dyes, quinoline dyes, anthraquinone dyes, benzophenone dyes, diphenylcyanoacrylate dyes, triazine dyes, and p-aminobenzoic acid dyes. Organic dyes are preferred because they will not remain in the insulation film after calcination, making it possible to prevent a decline of insulation film properties from being caused by the light absorber. Among these dyes, azo dyes and benzophenone dyes are preferred. It is preferred that the content of the organic dyes is 0.05 to 5 mass %, more preferably 0.05 to 1 mass %. If the content is smaller than the range, the effect of adding the light absorber tends to decrease, and if it is larger than the range, the insulation film properties after calcinaiton tend to decline.

Addition of a sensitizer is preferred for enhancing the sensitivity. Specifically, practical sensitizers include 2,4-diethylthioxanthone, isopropylthioxanthone, 2,3-bis (4-diethylaminobenzal) cyclopentanone, and 2,6-bis(4-dimethylaminobenzal) cyclohexanone, which may be used singly or in combination. In the case where a sensitizer is added to the photosensitive paste, its content is usually 0.05 to 10 mass %, more preferably 0.1 to 10 mass %, relative to the total weight of the photosensitive ingredient. If the amount of the sensitizer is smaller than the range, there arises a tendency that the effect of improving the photosensitivity cannot be exhibited, and if it is larger than the range, there arises a tendency that the remainder rate in the exposed area becomes small.

Practical organic solvents include methyl cellosolve, ethyl cellosolve, butyl cellosolve, propylene glycol monomethyl ether acetate, methyl ethyl ketone, dioxane, acetone, cyclohexanone, cyclopentanone, isobutyl alcohol, isopropyl alcohol, tetrahydrofuran, dimethyl sulfoxide, γ-butyllactone, N-methylpyrrolidone, N,N-dimethylformamide, N,N-dimethylacetamide, bromobenzene, chlorobenzene, dibromobenzene, dichlorobenzene, bromobenzoic acid, chlorobenzoic acid, and organic solvent mixtures containing one or more of the foregoing.

A photosensitive paste used for barrier rib formation is generally prepared by mixing the inorganic fine particles and organic ingredients in an appropriate composition and stirring and dispersing them homogeneously in a three-roll mill or kneading machine. Then, the photosensitive paste is applied, dried, exposed to light, and developed.

Application of the photosensitive paste for barrier rib formation can be carried out by screen printing, or using a bar coater, roll coater, die coater or blade coater.

Drying of coated surfaces can be carried out by using a forced air oven, hot plate or IR (infrared ray) furnace.

Active lights useful for the light exposure include visible light, near ultraviolet light, ultraviolet light, electron beam, X-ray, and laser. Of these, ultraviolet light is most preferred, and practical light sources include low-pressure mercury lamp, high-pressure mercury lamp, ultrahigh-pressure mercury lamp, halogen lamp, and germicidal lamp. If these, ultrahigh-pressure mercury lamp is suitable. The exposure conditions depend on the coating thickness, but an ultrahigh-pressure mercury lamp having an output of 1 to 100 mW/cm$^2$ is used and exposure is performed for 0.1 to 10 minutes.

Here, it is preferred to adjust the distance, or the gap, between the photomask and the surface of the coating film of the photosensitive paste to 50 to 500 μm, more preferably 70 to 400 μm. If the gap is 50 μm or more, more preferably 70 μm or more, the contact between the coating film of photosensitive paste and the photomask can be prevented to prevent their breakage or contamination. Further, if the gap is 500 μm or less, more preferably 400 μm or less, it will be possible to achieve sharp patterning.

A development process makes use of the difference in solubility in the developer between the exposed area and the non-exposed area. Development can be performed by various techniques such as immersion, spraying, and brushing.

The developer is a solution that can dissolve the target organic ingredients of the photosensitive paste, that is, non-exposed photosensitive organic ingredients in the case of a negative-type photosensitive paste or exposed photosensitive organic ingredients in the case of a positive-type photosensitive paste. If the target organic ingredients include a compound with an acid group such as carboxyl, an aqueous alkali solution can be used for development. Though the useful aqueous alkali solutions include inorganic alkali solutions such as an aqueous solution of sodium hydroxide, sodium carbonate or calcium hydroxide, the use of an aqueous organic alkali solution is preferred because the alkali component can be easily removed during calcination. A common amine compound can be used as the organic alkali. Practical ones include tetramethylammonium hydroxide, trimethylbenzylammonium hydroxide, monoethanolamine, and diethanolamine. The concentration of the alkali aqueous solution is usually 0.01 to 10 mass %, more preferably 0.1 to 5 mass %. If the alkali concentration is too low, there arises a tendency that the soluble area cannot be removed, and if the alkali concentration is too high, there arises a tendency that the pattern portions are peeled or that the non-soluble area is corroded. Further, it is preferred in view of process control that the development is performed at a development temperature of 20 to 50° C.

The pattern of the main barrier ribs and auxiliary barrier ribs obtained by development is then calcined in a firing furnace. The appropriate calcination atmosphere and temperature depend on the types of the paste and the substrate used, but calcination is performed in an atmosphere of air, nitrogen, or hydrogen. The useful firing furnaces include batch-type firing furnace and continuous roller hearth furnace. The preferable calcination temperature range is 400 to 800° C. In the case where the barrier ribs are formed directly on a glass substrate, it is preferred that they are maintained at a temperature of 450 to 620° C. for 10 to 60 minutes, followed by calcination.

Then, between the main barrier ribs formed in the direction parallel to the appropriate address electrodes, phosphor layers, each emitting red (R), green (G) or blue (B) light, are formed. The phosphor layers can be formed by applying phosphor pastes composed mainly of phosphor powder, organic binder and organic solvent between the appropriate main barrier ribs, and drying them, followed by calcination as required.

Methods useful for applying phosphor pastes to the spaces between the appropriate main barrier ribs include the screen printing method to print a pattern using a screen printing plate, the dispenser method to discharge a phosphor paste from the tip of a discharge nozzle to from a pattern, and the photosensitive paste method to apply a phosphor paste composed of the photosensitive organic ingredients. All these methods are useful to apply phosphor pastes to the spaces between the appropriate main barrier ribs, but the screen printing method and the dispenser method are preferred for the invention because of their low required cost.

The thickness of the red phosphor layer, $T_r$ (μm), that of the green phosphor layer, $T_g$ (μm), and theta of the blue phosphor layer, $T_b$ (μm), should preferably meet Equations (2) and (3) given below:

$$10 \leqq T_r \leqq T_b \leqq 50 \quad (2)$$

$$10 \leqq T_g \leqq T_b \leqq 50 \quad (3)$$

Thus, a plasma display panel having a good color balance (having high color temperature) can be produced by using a blue phosphor layer that is thicker than the green and red phosphor layers because the blue one is lower in brightness. The thickness of the phosphor layers should be 10 μm or more to achieve a sufficiently high brightness. The discharge space can be wider to increase the brightness if the thickness is 50 μm or less. The thickness of a phosphor layer in this case is measured at the intermediate point between the adjacent main barrier ribs and adjacent auxiliary barrier ribs after calcinations. Thus, this is the thickness of the phosphor layer formed at the bottom of the discharge space (the pixel surrounded by the main and auxiliary barrier ribs).

The rear plate can be produced by calcining the phosphor-coated layer as needed at 400 to 550° C.

To produce a plasma display panel, the rear plate and the front plate are sealed, and an electrical discharge gas consisting of helium, neon, xenon, etc., is encapsulated in the space formed between the rear plate and the front plate, followed by installing driver circuits. The front plate is produced by forming transparent electrodes, bus electrodes, dielectric layer, and protection layer in a pattern on a substrate. Color filter layers may be formed at the position of the red, green and blue phosphor layers on the rear plate. A black stripe may be provided to improve the contrast.

Figure 2:
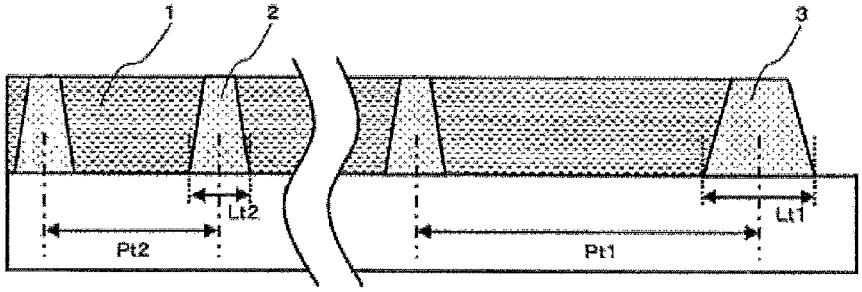
FIG. 2 is a schematic diagram of a transverse cross section of the rear plate for the plasma display of the invention.

Described below is a pitch between the main barrier ribs. In the case of a grid-like barrier rib pattern consisting of main barrier ribs and auxiliary barrier ribs running perpendicular to the former, the outermost main barrier rib among the main barrier ribs located in the non-display region at either transverse end of the display region is supported only by the adjacent auxiliary barrier ribs and the main barrier rib adjacent toward the display region, and the stress caused by the auxiliary barrier rib shrunken during calcinations is exerted only in one direction toward the display region. As a result, the outermost main barrier rib 3 is inclined and raised as compared with the other main barrier ribs 2 in the display region as shown in FIG. 1. If some barrier ribs are raised locally, undesired discharge will take place in the panel when it is activated, leading to deterioration in the display quality. A conventional solution for preventing the inclination of the outermost main barrier rib is to increase the width Lt1 of the outermost main barrier rib as compared with the main barrier ribs in the display region as shown in FIG. 2. If the interval Pt1 of the outermost main barrier rib is the same as the interval Pt2 of the main barrier ribs in the display region, it is impossible to increase the width Lt1 sufficiently to prevent the inclination, and therefore, the panel is designed so that the interval Pt1 is larger than the interval Pt2. It is preferred that Lt1 is 1.2 to 3 times Lt2. If it is less than 1.2 times, the inclination will not be prevented sufficiently while if it is more than 3 times, the shrinkage stress of the outermost main barrier rib in the width direction will increase undesirably, causing warp to raise the top portion.

In the case of the photosensitive paste method to produce main barrier ribs and auxiliary barrier ribs in a grid-like barrier rib pattern on a substrate, the substrate is first coated with the photosensitive paste designed for barrier rib formation, and exposed to light through a photomask having an intended grid-like pattern, followed by development and calcination. Care should be taken not to allow foreign matters, flaws, bubbles, etc. to occur on the photomask, which may result in a defective pattern.

Here, a coating film of a photosensitive paste for forming barrier ribs formed on a substrate is aligned to a photo mask having a desired grid-like pattern, and exposed to light (exposure operation 1), followed by shifting the substrate or the photomask by a desired distance, and carrying out exposure (exposure operation 2). This process serves to prevent defects such as inferior pattern formation. It is preferred that the shifting direction of the substrate or photomask is parallel to the direction of the auxiliary barrier rib or the direction of the main barrier rib and that if its movement direction is parallel to the direction of the auxiliary barrier rib, the length of the shift is an integral multiple of the main barrier rib pitch Pt2. If it is not an integral multiple, the position of the main barrier rib will be different between the exposure operation 1 and the exposure operation 2, making it difficult to prevent the defects sufficiently and control shape variations such as barrier rib width. The pitch Pt1 between the outermost main barrier rib among the main barrier ribs located in the non-display region at either transverse end of the display region and the main barrier rib next to it should be a 2 or more integral multiple of the pitch Pt2 between the main barrier ribs located in the display region in order to prevent the rise of the outermost main barrier rib. Furthermore, defects such as inferior pattern formation can be prevented by making the length of shift of the substrate or the photomask between the exposure operation 1 and exposure operation 2 equal to Pt2. However, if Pt1 is a 5 or more integral multiple, the pitch between the outermost main barrier rib 3 and the adjacent main barrier rib will be too large, and when such a front plate is used to produce a panel, an excessive stress can be exerted on the outermost main barrier rib, leading to defective formation of barrier ribs.

If the shifting direction is parallel to the main barrier rib, it is preferred that the length of the shift is an integral multiple of the pitch between the auxiliary barrier ribs. More preferably, it should be equal to the pitch between the auxiliary barrier ribs. It is not an integral multiple, it will be difficult to control the shape of the transverse barrier ribs.

EXAMPLES

The invention is illustrated more specifically below with reference to Examples. However, they are not intended to place any limitations on the invention.

The evaluation methods to be used are described first. With respect to defects in barrier ribs formed, evaluation was performed with the rear plate. With respect to undesired electrical discharge and defective formation of the outermost main barrier rib, evaluation was performed with the plasma display panel.

<Defective Formation of Barrier Ribs>

A rear plate produced was produced and subjected to visual observation under transmitted light to detect disconnections in the barrier rib pattern. Evaluations were made according to the following criteria.

○: no disconnections detected

X: some disconnections detected

<Undesired Electrical Discharge>

A voltage of 140V was applied to the scan electrode, 200V to the sustain electrode, and 70V to the address electrode in a PDP produced, and the R, G, and B elements were activated separately in this order. The number of cells that emit light of an unintended color (G or B when R light is expected, B and R when G light is expected, and R and G when B light is expected) due to undesired electrical discharge was counted and evaluations were made according to the following criteria.

○: Not more than 5 cells per panel emitted light of an unintended color.

Δ: 6 to 10 cells per panel emitted light of an unintended color.

X: 11 or more cells per panel emitted light of an unintended color.

<Loss of Outermost Main Barrier Rib>

The rear plate of a PDP produced was observed under a microscope (supplied by Keyence Corporation) to determine the existence of the outermost main barrier rib among the main barrier ribs located in the non-display region at either transverse end of the display region, and evaluations were made according to the following criteria.

○: no loss

Δ: partial loss without collapse of the barrier rib

X: collapse of the barrier rib

The production processes used are described below.

Examples 1 to 4, and Comparative examples 1 and 2

A 590×964×1.8 mm, that is, a PD-200 of 42 inch size plate (produced by Asahi Glass Co., Ltd.) was used as a glass substrate. On the substrate, stripe-like electrodes having pitch of 240 μm, line width of 100 μm, post-calcination thickness of 3 μm to serve as writing electrodes were formed by photolithography using a photosensitive silver paste consisting of 70 parts by weight of silver powder having an average particle diameter of 2.0 μm, 2 parts by weight of glass powder with a composition of $Bi_2O_3/SiO_2/Al_2O_3/B_2O_3$=69/24/4/3 (by mass %) having an average particle diameter of 2.2 μm, 8 parts by weight of a copolymer consisting of acrylic acid, methyl methacrylate, and styrene, 7 parts by weight of trimethylolpropane triacrylate, 3 parts by weight of benzophenone, 7 parts by weight of butylcarbitol acrylate, and 3 parts by weight of benzyl alcohol.

This substrate was then coated with a dielectric paste consisting of 60 parts by weight of low-melting glass fine particles with a composition of $Bi_2O_3/SiO_2/Al_2O_3/ZnO/B_2O_3$=78/14/3/3/2 (by mass %) having a volume average particle diameter of 2 μm, 10 parts by weight of titanium oxide powder having an average particle diameter of 0.3 μm, 15 parts by weight of ethyl cellulose, and 15 parts by weight of terpineol, followed by calcinations at 580° C. to produce a dielectric layer having a thickness of 10 μm.

The photosensitive paste for barrier rib formation was prepared by mixing and dispersing the following components.

| | |
|---|---|
| Glass powder: glass powder with a composition of $Bi_2O_3/SiO_2/Al_2O_3/ZnO/B_2O_3$ = 82/6/3/6/3 (by mass %) having an average particle diameter of 2 μm | 67 parts by weight |
| Filler: titanium oxide having an average particle diameter of 0.2 μm | 3 parts by weight |

-continued

| | |
|---|---|
| Polymer: 10 parts by weight of Cyclomer P (ACA250, supplied by Daicel Chemical Industries, Ltd.) | 10 parts by weight |
| Organic solvent (1): benzyl alcohol | 4 parts by weight |
| Organic solvent (2): butylcarbitol acerate | 3 parts by weight |
| Monomer: dipentaerythritol hexaacrylate | 8 parts by weight |
| Photopolymerization initiator: benzophenone | 3 parts by weight |
| Antioxidant: 1,6-hexanediol-bis-[(3,5-di-t-butyl-4-hydroxy phenyl) propionate] | 1 part by weight |
| Organic dye: Basic Blue 26 | 0.01 part by weight |
| Thixotropic agent: N,N'-12-hydroxy stearate butylene diamine | 0.5 part by weight |
| Surface active agent: polyoxyethylene cetyl ether | 0.49 part by weight |

Figure 3:
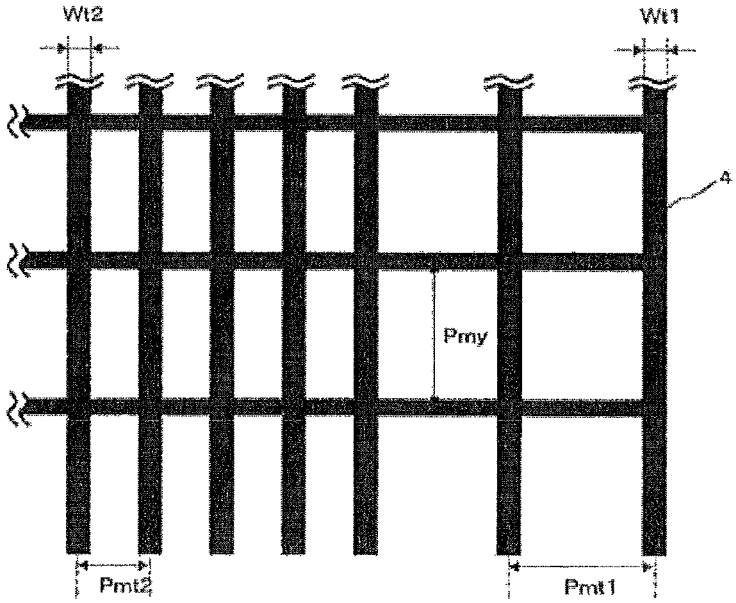
FIG. 3 is a schematic diagram of a photomask pattern used for the invention.

The photosensitive paste for barrier rib formation was applied with a dye coater up to a thickness of 250 μm and dried in a clean oven at 100° C. for 40 minutes to form a coating film. On top of it, the photosensitive paste for barrier rib formation was applied with a dye coater up to a thickness of 50 μm and dried in a clean oven at 100° C. for 30 minutes to form a coating film. On the coating film, a photomask having an intended grid-like pattern was positioned accurately, followed by light exposure (exposure operation 1). Then, the substrate or photomask was shifted in the direction parallel to the auxiliary barrier ribs over an appropriate distance S (μm) as shown in Table 1, and positioned again, followed by light exposure (exposure operation 2). The photomask had a pattern as shown in FIG. 3. The pitch Pmt1 (μm) between the transparency for the transversely outermost main barrier rib and the transparency for the adjacent main barrier rib, the pitch Pmt2 (μm) between the transparencies for the main barrier ribs located in the transverse central region, the pitch Pmy (μm) between the transparencies for the auxiliary barrier ribs, the width Wt1 (μm) of the transparency for the transverse outermost main barrier rib, and the width Wt2 (μm) of the main barrier ribs located in the transverse central region are shown in Table 1 for each Example and Comparative example.

The photomask gap was adjusted to 150 μm, and the total light exposure during the exposure operations 1 and 2 was adjusted to 400 mJ/cm$^2$.

Figure 4:
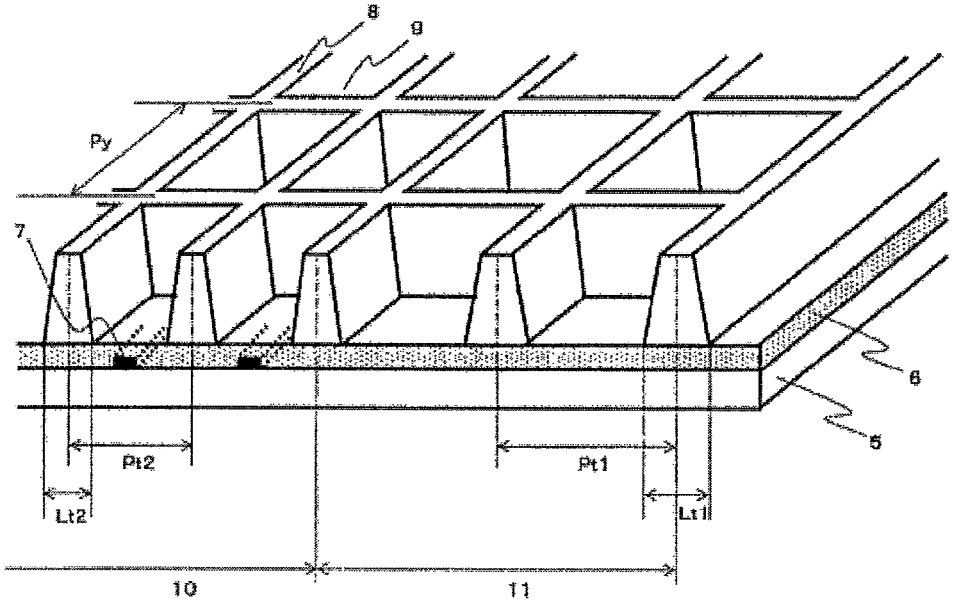
FIG. 4 is a schematic diagram of a barrier rib pattern produced according to the invention.
Figure 5:
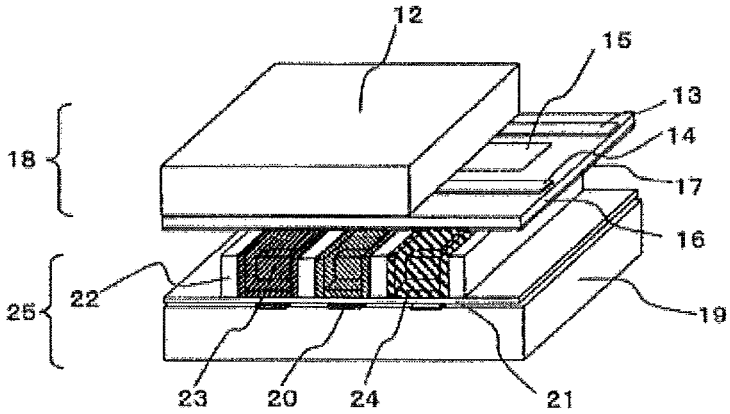
FIG. 5 is a schematic diagram of a plasma display panel.

The light-exposed substrate as produced above was developed with a 0.5 mass % sodium carbonate solution to produce a barrier rib pattern. The patterned substrate was calcined at 560° C. for 15 minutes. The resulting substrate is illustrated schematically in FIG. 4. Table 1 gives measurements of the pitch Pt1 (μm) between the outermost main barrier rib among the main barrier ribs located in the non-display region at either transverse end of the display region and the main barrier rib next to it, the pitch Pt2 (μm) between the main barrier ribs located in the display region, the pitch Py (μm) between the auxiliary barrier ribs, the bottom width Lt1 (μm) of the outermost main barrier rib among the main barrier ribs located in the non-display region at either transverse end of the display region, and the bottom width Lt2 (μm) of the main barrier ribs located in the display region.

Phosphor pastes of each of colors were spread between the barrier ribs by screen printing, followed by calcinations (500° C., 30 min) to form a phosphor layer on the sides and bottom of the barrier ribs.

Subsequently, the front plate was produced by the following process. A 590×964×2.8 mm, that is, a PD-200 of 42 inch size plate (produced by Asahi Glass Co., Ltd.) was used as a glass substrate. On the glass substrate, ITO was formed by sputtering, and a resist was spread, followed by light exposure, development, and etching to produce transparent elec trodes having a thickness of 0.1 μm and a line width of 200 μm. In addition, a photosensitive silver paste composed of black silver powder was spread and subjected to photolithography to produce scan electrodes and sustain electrodes having a post-calcination thickness of 5 μm. The electrodes had a pitch of 500 μm and a line width of 80 μm.

Then, a glass paste prepared by kneading 70 parts by weight of low-melting glass containing 75 mass % lead oxide, 20 parts by weight of ethyl cellulose, and 10 parts by weight of terpineol was spread by screen printing to form coating film having a thickness of 50 μm to cover the bus electrodes in the display region, followed by calcinations at 570° C. for 15 minutes to produce front dielectric layers.

After the dielectric formation, a magnesium oxide layer having a thickness of 0.5 is μm to serve as protection layer was formed by electron beam deposition on the substrate to produce a front plate.

The resulting front plate and rear plate was combined with sealing glass and Ne gas with a 5% Xe content was encapsulated with an internal gas pressure of 66,500 Pa, followed by installing a driver circuit to produce a plasma display panel.

Evaluation results are shown in Table 1.

TABLE 1

| | | | Example 1 | Example 2 | Example 3 | Example 4 |
|---|---|---|---|---|---|---|
| Light exposure through gird-like photomask | Photomask | Pmt1 (μm) | 300 | 600 | 750 | 280 |
| | | Pmt2 (μm) | 150 | 150 | 150 | 150 |
| | | PmtI/Pmt2 | 2.0 | 4.0 | 5.0 | 2 |
| | | Wt1 (μm) | 50 | 50 | 50 | 50 |
| | | Wt2 (μm) | 25 | 25 | 25 | 25 |
| | | Pmy (μm) | 450 | 450 | 450 | 450 |
| | Shifting direction | | Parallel to auxiliary barrier rib | Parallel to auxiliary barrier rib | Parallel to auxiliary barrier rib | Parallel to main barrier rib |
| | Shift | S (μm) | 300 | 600 | 750 | 450 |
| Barrier rib shape | | Pt1 (μm) | 300 | 600 | 750 | 300 |
| | | Pt2 (μm) | 150 | 150 | 150 | 150 |
| | | Pt1/Pt2 | 2.0 | 4.0 | 5.0 | 2 |
| | | Lt1 (μm) | 100 | 100 | 100 | 100 |
| | | Lt2 (μm) | 50 | 50 | 50 | 50 |
| | | Py (μm) | 450 | 450 | 450 | 450 |
| Evaluations | | Defective barrier rib formation | ○ | ○ | ○ | ○ |
| | | Undesired discharge | ○ | ○ | ○ | ○ |
| | | Loss of outermost main barrier rib | ○ | ○ | Δ | ○ |

| | | | Comparative example 1 | Comparative example 2 | Comparative example 3 |
|---|---|---|---|---|---|
| Light exposure through gird-like photomask | Photomask | Pmt1 (μm) | 150 | 250 | 150 |
| | | Pmt2 (μm) | 150 | 150 | 150 |
| | | PmtI/Pmt2 | 1.0 | 1.7 | 1.0 |
| | | Wt1 (μm) | 25 | 50 | 25 |
| | | Wt2 (μm) | 25 | 25 | 25 |
| | | Pmy (μm) | 450 | 450 | 450 |
| | Shifting direction | | Parallel to auxiliary barrier rib | — | Parallel to auxiliary barrier rib |
| | Shift | S (μm) | 150 | 0 | 450 |
| Barrier rib shape | | Pt1 (μm) | 150 | 250 | 150 |
| | | Pt2 (μm) | 150 | 150 | 150 |
| | | Pt1/Pt2 | 1.0 | 1.7 | 1.0 |
| | | Lt1 (μm) | 50 | 100 | 50 |
| | | Lt2 (μm) | 50 | 50 | 50 |
| | | Py (μm) | 450 | 450 | 450 |
| Evaluations | | Defective barrier rib formation | ○ | X | ○ |
| | | Undesired discharge | X | X | X |
| | | Loss of outermost main barrier rib | ○ | ○ | ○ |

Plasma display panels having high productivity and display quality were obtained in Examples 1 to 4, whereas those obtained in Comparative examples 1 to 3 were inferior in productivity or display quality.

The invention claimed is:

1. A plasma display member comprising a plurality of substantially stripe-shaped address electrodes formed on a substrate, a dielectric layer covering the address electrodes, main barrier ribs located on the dielectric layer and formed substantially parallel with the address electrodes, and auxiliary barrier ribs formed perpendicular to the main barrier ribs, wherein the pitch between the outermost main barrier rib among the main barrier ribs located in a non-display region on both sides in the lateral direction of a display region and the main barrier rib adjacent to the outermost main barrier rib is integer times the pitch between the main barrier ribs located in the display region, where the integer is two or more.

2. The plasma display member according to claim 1, wherein the pitch between the outermost main barrier rib among the main barrier ribs located in a non-display region on both sides in the lateral direction of a display region and the main barrier rib adjacent to the outermost main barrier rib is integer times the pitch between the main barrier ribs located in the display region, where the integer is two, three or four.

3. A plasma display member manufacturing method which comprises exposing a display member material comprising a plurality of substantially stripe-shaped address electrodes or precursors thereof formed on a substrate, a dielectric layer or a precursor thereof covering the address electrodes or the precursors thereof and a photosensitive glass paste layer formed on the dielectric layer or the precursor thereof, to light through a photomask having a grid-like pattern of transparencies substantially parallel and perpendicular to the address electrodes or the precursors thereat two or more times, followed by development and calcination, to produce a barrier rib grid consisting of main barrier ribs substantially parallel to the address electrodes, and auxiliary barrier ribs perpendicular to the main barrier ribs, wherein the pitch between a transparent portion for forming a main barrier rib located outermost in the lateral direction and a transparent portion for forming a main barrier rib adjacent thereto in the photomask is the integer times of at least two of the pitch between transparent portions for forming a main barrier ribs located in the central region in the lateral direction, and during at least twice of the exposing the photomask and the substrate are relatively moved each other in a direction parallel to the auxiliary barrier rib so that a moving distance is integer times of the pitch between the transparent portion of the main barrier rib located outermost in the lateral direction and the transparent portion of the main barrier rib adjacent thereof.

4. The plasma display member manufacturing method according to claim 3, wherein the pitch between the transparent portion of the main barrier rib located outermost in the lateral direction and the transparent portion of the main barrier rib adjacent thereof are the integer times of two, three or four.

5. A plasma display member manufacturing method which comprises exposing a display member material comprising a plurality of substantially stripe-shaped address electrodes or precursors thereof formed on a substrate, a dielectric layer or a precursor thereof covering the address electrodes or the precursors thereof and a photosensitive glass paste layer formed on the dielectric layer or the precursor thereof, to light through a photomask having a grid-like pattern of transparencies substantially parallel and perpendicular to the address electrodes or the precursors thereof, two or more times, followed by development and calcination, to produce a barrier rib grid consisting of main barrier ribs substantially parallel to the address electrodes, and auxiliary barrier ribs perpendicular to the main barrier ribs, wherein the pitch between a transparent portion for forming a main barrier rib located outermost in the lateral direction and a transparent portion for forming a main barrier rib adjacent thereto in the photomask is the integer times of at least two of the pitch between transparent portions for forming a main barrier ribs located in the central region in the lateral direction, and during at least twice of the exposing the photomask and the substrate are relatively moved each other in a direction parallel to the main barrier rib so that a moving distance is integer times of the pitch between the transparent portion of the auxiliary barrier rib located outermost in the vertical direction and the transparent portion of the auxiliary barrier rib adjacent thereof.

* * * * *